US005799856A

United States Patent [19]

Mukoyama

[11] Patent Number: 5,799,856

[45] Date of Patent: Sep. 1, 1998

[54] FASTENER DRIVING TOOL

[75] Inventor: Kenji Mukoyama, Anjo, Japan

[73] Assignee: Makita Corporation, Anjo, Japan

[21] Appl. No.: 731,972

[22] Filed: Oct. 23, 1996

[30] Foreign Application Priority Data

Oct. 24, 1995 [JP] Japan ..... 7-275696

[51] Int. Cl.[6] ..... B25C 1/04

[52] U.S. Cl. ..... 227/112; 227/119; 227/136

[58] Field of Search ..... 227/112, 110, 227/119, 135, 136, 138, 116, 128, 131, 107

[56] References Cited

U.S. PATENT DOCUMENTS

| | | | |
|---|---|---|---|
| 3,915,367 | 10/1975 | Potucek | 227/136 |
| 3,945,551 | 3/1976 | Sato et al. | 227/136 |
| 4,463,888 | 8/1984 | Geist et al. | 227/119 |
| 4,942,996 | 7/1990 | Wolfberg et al. | 227/128 |
| 5,240,161 | 8/1993 | Kaneko | 227/136 |
| 5,273,200 | 12/1993 | Hoefler | 227/136 |
| 5,683,024 | 11/1997 | Eminger et al. | 227/136 |

FOREIGN PATENT DOCUMENTS

| | | |
|---|---|---|
| 28708 | 3/1990 | Japan . |
| 6247718 | 7/1990 | Japan . |
| 616661 | 5/1994 | Japan . |

*Primary Examiner*—Scott A. Smith

*Attorney, Agent, or Firm*—Dennison, Meserole, Pollack & Scheiner

[57] ABSTRACT

A fastener driving tool includes a fastener driving device for driving fasteners one after another. The fasteners are connected in series to each other to form a strip of fasteners. A fastener feeding device is provided for feeding the fasteners one after another to a driving position by the fastener driving device. The fastener feeding device includes a first claw and a second claw positioned forwardly of the first claw in the feeding direction of the fasteners. A drive device is provided for reciprocally moving each of the first and second claws between a frontmost position and a rearmost position. A stroke adjusting device is operable to provide difference between the stroke of movement of the first claw and the stroke of movement of the second claw, so that the stroke of movement of the second claw is smaller than the stroke of movement of the first claw.

8 Claims, 5 Drawing Sheets

FASTENER DRIVING TOOL

FIELD OF THE INVENTION

The present invention relates to a fastener driving tool such as a nailer which includes a fastener feeding device for feeding fasteners one after another to a driving device where the fasteners are driven out from the tool.

DESCRIPTION OF THE PRIOR ART

With a conventional nailer, a nail feeding device is provided for feeding nails one after another to a nail driving device. The nails are connected in series with each other by means of wires or the like to form a strip of nails, and the nail feeding device includes a feeding claw member which is adapted to engage one of the nails. The feeding claw member is mounted on a piston which is reciprocally moved forwardly and rearwardly in response to the operation of the nail driving device. When the feeding claw member is moved from its rearmost position to its frontmost position by the piston, the feeding claw member engages one of the nails and moves the strip of nails forwardly by a distance corresponding to a pitch of the nails in the strip, so that the nail to be driven is fed into a driver guide of the nail driving device through which a driver is moved to drive the nails. After the first nail has been fed into the driver guide, the feeding claw member is returned to its rearmost position and is then moved forwardly to engage the next one of the nails. In order to prevent the strip of nails from moving rearwardly when the feeding claw member is moved rearwardly, a detent claw is provided on the nail feeding device.

The feeding claw member includes a rear claw and a front claw. The rear claw is adapted to engage one of the nails for feeding the nails other than the rearmost one, and the front claw is adapted to engage the rearmost one of the nails which cannot be engaged by the rear claw. The distance between the rear claw and the front claw is appropriately determined according to the pitch of the nails in the strip to be fed.

The conventional feeding device may not cause any problem when it is adapted for feeding the strips of nails having the same nail pitch such as 8 mm for which the distance between the rear claw and the front claw has been determined. However, when the feeding device is adapted for feeding the strip of nails having a smaller nail pitch such as 6 mm, the feeding device may tend to feed two nails by one stroke movement of the feeding claw member.

Thus, in case of the strip of nails having the smaller nail pitch, at the rear stroke end of the feeding claw member, the front claw may be positioned rearwardly of the nail to be engaged by the rear claw. Since the nail to be fed into the driver guide is positioned forwardly adjacent the nail to be engaged by the rear claw, two nails are fed into the driver guide by the front claw as the feeding claw member is moved forwardly.

SUMMARY OF THE INVENTION

It is, accordingly, an object of the present invention to provide a fastener driving tool having a fastener feeding device which is operable to reliably feed nails in a strip of nails one after another even when the strip of nails is one having a nail pitch smaller than a nail pitch for which the feeding device has been designed.

According to the present invention, in a fastener driving tool having a fastener driving device for driving fasteners one after another, the fasteners being connected in series to each other to form a strip of fasteners, the improvement comprising:

a fastener feeding device for feeding the fasteners one after another to a driving position by the fastener driving device;

the fastener feeding device including:

a first claw and a second claw positioned forwardly of the first claw in the feeding direction of the fasteners;

a drive device for reciprocally moving each of the first and second claws between a frontmost position and a rearmost position; and a stroke adjusting device for providing difference between the stroke of movement of the first claw and the stroke of movement of the second claw, so that the stroke of movement of the second claw is smaller than the stroke of movement of the first claw.

With this construction, the second claw in the rearmost position may not be positioned rearwardly of the nail to be engaged by the first claw, so that the nails can be reliably fed one after another by the first claw.

The invention will become more apparent from the appended claims and the description as it proceeds in connection with the drawings.

DETAILED DESCRIPTION OF THE PREFERRED EMBODIMENTS

An embodiment of the present invention will now be explained with reference to the drawings.

Figure 1:
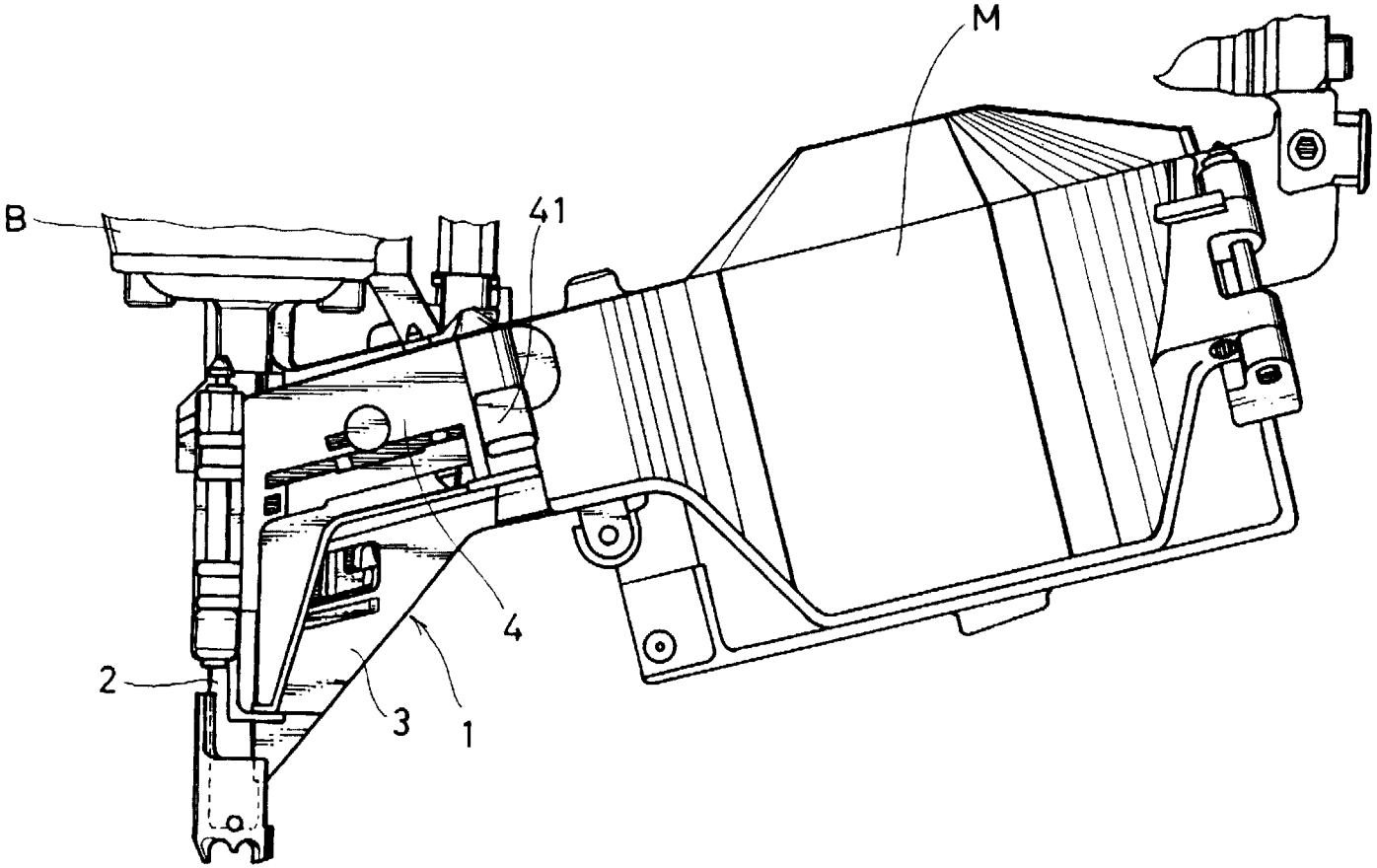
FIG. 1 is a right side view showing the essential parts of a nailer according to an embodiment of the present invention.

FIG. 1 shows the essential parts of a nailer having a nail feeding device 1. The nail feeding device 1 is disposed between a driver guide 2 extending downwardly from a machine body B and a magazine M for storing a strip of nails N (see FIGS. 7(A) to 7(C)) in coiled form. The nail feeding device 1 has a door 4 and an operation knob 41 for opening and closing the door 4. In FIG. 1, the nail feeding device 1 is shown in a closed state. The nail feeding device 1 in an open state is shown in FIG. 2.

The door 4 is pivotally connected to a flat plate-like guide wall 3 which is fixedly connected to the driver guide 2 and extends rearwardly therefrom. A cylinder 5*a* having a piston 5 is mounted on the guide wall 3, and a feeding claw member 6 for feeding nails $n_0$ to $n_n$ connected by wires in the strip of nails N is connected to the piston 5. A detent claw member 7 is mounted on the door 4.

Figure 7A:
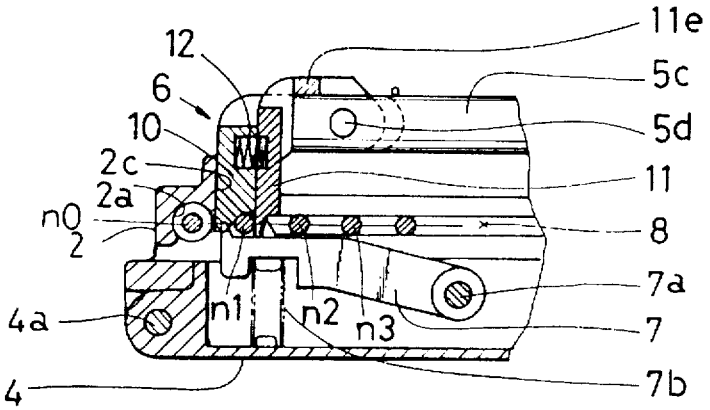
FIGS. 7(A) to 7(C) are sectional views showing the operation of the nail feeding device in sequence.
Figure 7B:
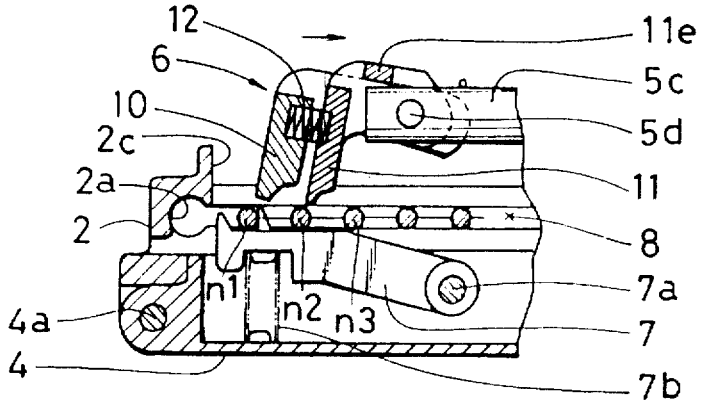
Figure 7C:
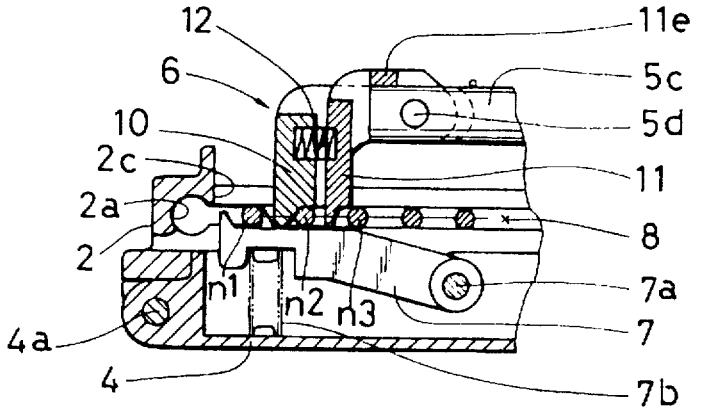

The driver guide 2 has a substantially cylindrical configuration and has a nail drive channel 2*a* formed therein (see FIGS. 7(A) to 7(C)). A driver 2*b* shown in FIG. 2 is connected to a drive piston of a piston-cylinder mechanism (not shown). The piston-cylinder mechanism is driven by compressed air and is disposed within the machine body B, so that the driver 2*b* is reciprocally moved within the nail drive channel 2*a* for driving the nails $n_0$ to $n_n$ one after another from the lower open end of the driver guide 2.

Figure 2:
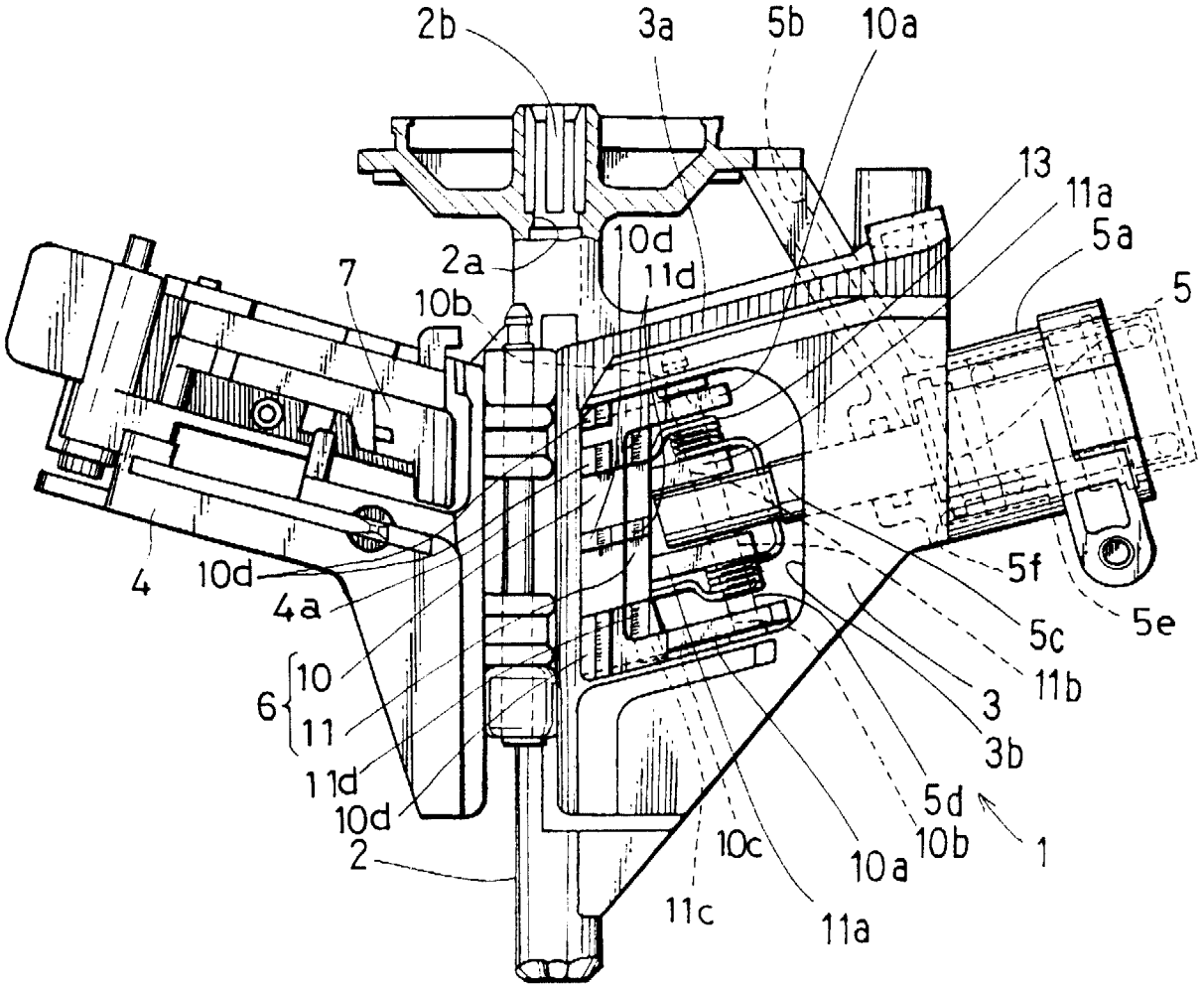
FIG. 2 is a right side view of a nail feeding device of the nailer with a door of the nail feeding device opened.

As shown in FIG. 2, a guide recess 3*a* is formed in the upper portion of the guide wall 3 and extends substantially perpendicular to the nail drive channel 2*a* for providing a guide for heads of the nails $n_0$ to $n_n$. The nail drive channel 2*a* is opened at its rear side (right side as viewed in FIG. 2), so that the nail drive channel 2*a* is in communication with a nail feeding channel 8 (see FIGS. 7(A) to 7(B)) which is formed between the guide wall 3 and the door 4 in the closed position. A central window 3*b* is formed in the guide wall 3, so that the feeding claw member 6 positioned laterally of the guide wall 3 protrudes into the nail feeding channel 8 through the window 3*b*.

Here, the driver guide 2 and the guide wall 3 are formed integrally with each other and are fixedly connected to the machine body B. The door 4 is pivotally connected to the drive guide 2 by means of a pin 4*a* (see FIG. 2). The magazine M is connected between the guide wall 3 and the rear end of the machine body M and can be opened when the door 4 is open.

Figure 3:
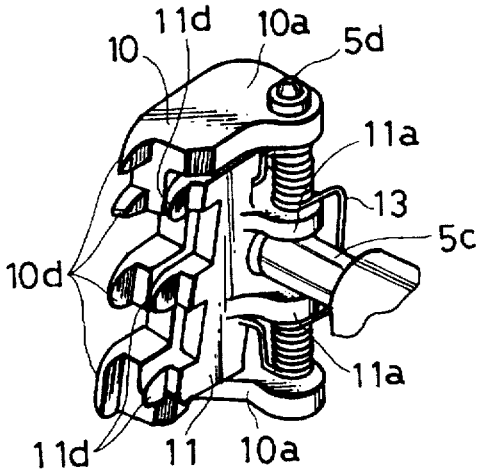
FIG. 3 is a perspective view of a feeding claw member of the nail feeding device.
Figure 4:
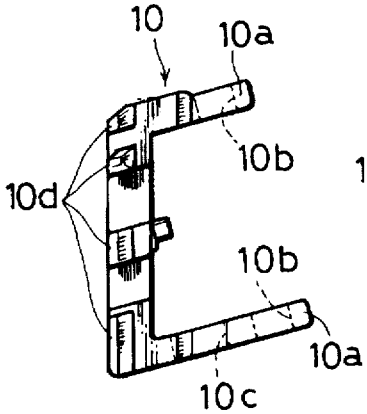
FIG. 4 is a side view of a front claw of the feeding claw member.
Figure 5:
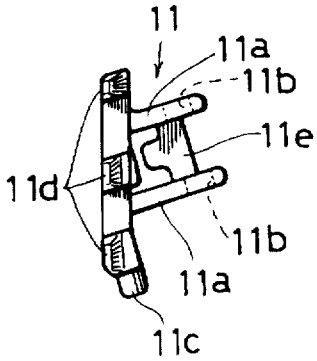
FIG. 5 is a side view of a rear claw of the feeding claw member.

The cylinder 5*a* is formed integrally with the guide wall 3 and its piston 5 is positioned on the lateral side (back side) of the guide wall 3. The cylinder 5*a* has an air chamber 5*f* connected to a return air chamber (not shown) by means of a communication channel 5*b*. The return air chamber serves to store the compressed air used for driving the piston-cylinder mechanism of the driver 2*b* and the compressed air is accumulated within the return air chamber when the drive piston of the piston-cylinder mechanism has been moved downwardly for moving the driver 2*b*. When the compressed air is accumulated in the return air chamber, the piston 5 is positioned in its rearmost position against the biasing force of a compression spring 5*e* disposed within the cylinder 5*a*. The return air chamber is open to the atmosphere when the piston of the piston-cylinder mechanism is moved upwardly, so that the piston 5 is moved forwardly by the force of the compression spring 5*e*. The piston 5 is then moved rearwardly when the compressed air is again accumulated within the return air chamber. Thus, the piston 5 is reciprocally moved in response to the movement of the driver 2*b*. As shown in FIGS. 2 and 3, the piston 5 has a piston rod 5*c* on which the feeding claw member 6 is mounted. The feeding claw member 6 includes a front claw 10 and a rear claw 11 arranged in the feeding direction of the nails $n_0$ to $n_n$. The front claw 10 and the rear claw 11 are formed separately from each other. As shown in FIGS. 3 and 4, the front claw 10 includes a front portion having claw parts 10*d* for engaging the nail $n_n$ which is the nail in the rearmost position in the strip of nails N. As shown in FIGS. 3 and 5, the rear claw 11 includes a front portion having claw parts 11*d* for engaging the nails $n_2$ to $n_{n-1}$ as will be explained later. The front claw 10 includes a pair of support legs 10*a* each having an insertion hole 10*b* for receiving a support pin 5*d* which is mounted on the front end of the piston rod 5*c* and intersects the piston rod 5*c* in a diametrical direction thereof. The rear claw 11 includes a pair of support legs 11*a* each having an insertion hole 11*b* for receiving the support pin 5*d*. Thus, the front claw 10 and the rear claw 11 are pivotally mounted on the piston rod 5*c* by means of the support pin 5*d*.

A return spring 13 is interposed between the rear claw 11 and the piston rod 5*c*, so that the rear claw 11 is normally biased in a direction in which the claw parts 11*d* protrude into the nail feeding channel 8.

Each of the support holes 10*b* of the front claw 10 has a configuration elongated in the feeding direction of the nails n, so that the front claw 10 is movable relative to the rear claw 11 in the feeding direction within the movable range of the front claw 10 relative to the support pin 5*c*. Thus, the distance between the front claw 10 and the rear claw 11 can be varied between a largest distance L and a smallest distance S as will be explained later, and therefore, the front claw 10 can be moved relative to the rear claw 11 by the stroke of L–S.

A compression spring 12 (see FIGS. 7(A) to 7(C)) is interposed between the front claw 10 and the rear claw 11 so as to normally keep the largest distance L between the front claw 10 and the rear claw 11. Thus, in order to vary the distance, the front claw 10 must be moved against the biasing force of the spring 12.

Figure 6:
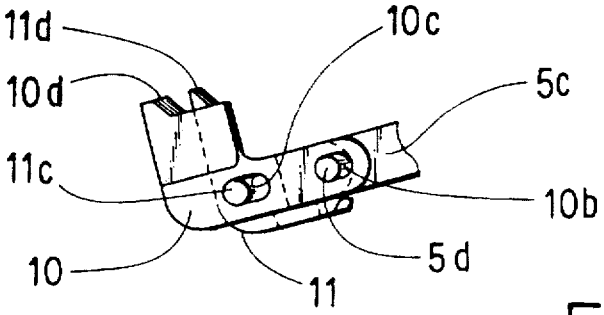
FIG. 6 is a bottom view of the feeding claw member.

As shown in FIGS. 4 and 6, the rear claw 11 has a protrusion 11*c* extending downwardly therefrom. The protrusion 11*c* is in engagement with an insertion hole 10*c* formed in the lower support leg 10*a* of the front claw 10. The insertion hole 10*c* is elongated in the nail feeding direction, so that the front claw 10 is movable relative to the rear claw 11 in the feeding direction but is not pivotable relative to the rear claw 11. Thus, the front claw 10 is pivoted together with the rear claw 11 as the rear claw 11 is pivoted about the support pin 5*d*.

As shown in FIG. 5, a stopper portion 11*e* is formed between the support legs 11*a* of the rear claw 11. The stopper portion 11*e* serves to laterally abut on the rod 5*c* for limiting a most protruding position of the claw parts 11*d* into the nail feeding channel 8 or a most protruding position of the claw parts 10*d* of the front claw 10 against the biasing force of the return spring 13.

As shown in FIGS. 7(A) to 7(C), the detent claw member 7 provided on the door 4 is positioned to confront the feeding claw member 6 when the door 4 is closed. The detent claw member 7 is pivotally mounted on the door 4 by means of a support pin 7*a*. A compression spring 7*b* is interposed between the door 4 and the detent claw member 7 for normally biasing the detent claw member 7 in a direction in which the detent claw member 7 protrudes into the nail feeding channel 8.

The operation of the above embodiment will now be explained.

In the initial state shown in FIG. 7(A), the feeding claw member 6 is in its frontmost position where the front claw 10 is in abutment on a wall part 2*c* of the driver guide 2 and where the spring 12 is compressed to provide the smallest distance S between the front claw 10 and the rear claw 11. A strip of nails N8 having the nails $n_0$ to $n_n$ spaced from each other by a pitch of 8 mm is set in the nail feeding channel 8. In the initial state, the frontmost nail $n_0$ is positioned within the nail drive channel 2*a*, the first nail $n_1$ to be driven at the next time is positioned between the front claw 10 and the rear claw 11, and the second nail and its subsequent nails $n_2$, $n_3$, - - - $n_n$ are positioned rearwardly of the rear claw 11.

When an operator pulls a trigger (not shown) for moving the drive piston of the piston-cylinder mechanism and for moving the driver 2*a*, the frontmost nail $n_0$ is driven out from the driver guide 2. The compressed air is then accumulated into the return air chamber, so that the compressed air is supplied to the compression chamber 5*f* of the cylinder 5a via the communication channel 5b. The piston 5 is therefore moved against the biasing force of the spring 5e, so that the feeding claw member 6 is moved rearwardly from the position shown in FIG. 7(A).

At the beginning of the rearward movement of the feeding claw member 6, the front claw 10 is held in abutment on the wall part 2c, and only the rear claw 11 is moved rearwardly together with the piston 5. The distance between the front claw 10 and the rear claw 11 is therefore increased. The front claw 10 is moved rearwardly together with the rear claw 11 after the distance has been increased to the largest distance L.

As the feeding claw member 6 is moved rearwardly, the feeding claw member 6 is pivoted about the support pin 5d in a direction moving away from the nail feeding channel 8 through abutment of the front claw 10 on the first nail $n_1$ and through abutment of the rear claw 11 on the second nail $n_2$, so that the front claw 10 and the rear claw 11 can pass over their rearwardly confronting nails.

During such a rearward movement of the feeding claw member 6, the strip of nails N8 is prevented from rearward movement by the detent claw member 7 which is in engagement with the first nail $n_1$.

When the feeding claw member 6 reaches its rearmost position, the front claw 10 is brought to enter between the first nail $n_1$ and the second nail $n_2$, and the rear claw 11 is brought to enter between the second nail $n_2$ and the third nail $n_3$ as shown in FIG. 7(C).

When the trigger for actuation of the piston-cylinder mechanism for moving the driver 2 is released, the drive piston of the piston-cylinder mechanism is moved upwardly, so that the driver 2b is moved upwardly to retract from the drive channel 2a of the driver guide 2. The pressure within the return air chamber is then gradually decreased, so that the pressure within the compression chamber 5f of the cylinder 5a is gradually decreased. When the force applied to the piston 5 by the air within the compression chamber 5f is decreased to have a value smaller than the force applied by the compression spring 5e, the piston 5 is moved forwardly, so that the feeding claw member 6 is moved forwardly from its rearmost position. As the feeding claw member 6 is thus moved forwardly, the rear claw 11 engages the second nail $n_2$ and moves the strip of nails N8 forwardly by a distance corresponding to the pitch of the nails in the strip of nails N8, so that the first nail $n_1$ is fed into the drive channel 2a of the driver guide 2. The nail feeding device 1 is thus returned to the initial state shown in FIG. 7(A).

During the movement of the feeding claw member 6 from the position shown in FIG. 7(C) to the position shown in FIG. 7(A), the front claw 10 and the rear claw 11 are spaced from each other by the largest distance L for the first time. Immediately before the feeding claw member 6 reaches its frontmost stroke end, the front claw 10 abuts on the wall part 2c of the driver guide 2, so that the rear claw 11 is moved forwardly to approach the front claw 10 through compression of the spring 12. Thus, the distance is varied from L to S.

As described above, when the feeding claw member 6 is moved rearwardly, the front claw 10 is started to move rearwardly after the rear claw 11 has started to move rearwardly, and the distance S between the front claw 10 and the rear claw 11 is varied from S to L during the rearward movement of the feeding claw member 6. This means that the stroke of movement of the front claw 10 is smaller than that of the rear claw 11 by the distance L–S. By virtue of this difference in stroke movement between the front claw 10 and the rear claw 11, the feeding device 1 is operable to reliably feed nails in a strip of nails having a nail pitch smaller than 8 mm as will be explained with reference to FIG. 8.

Figure 8:
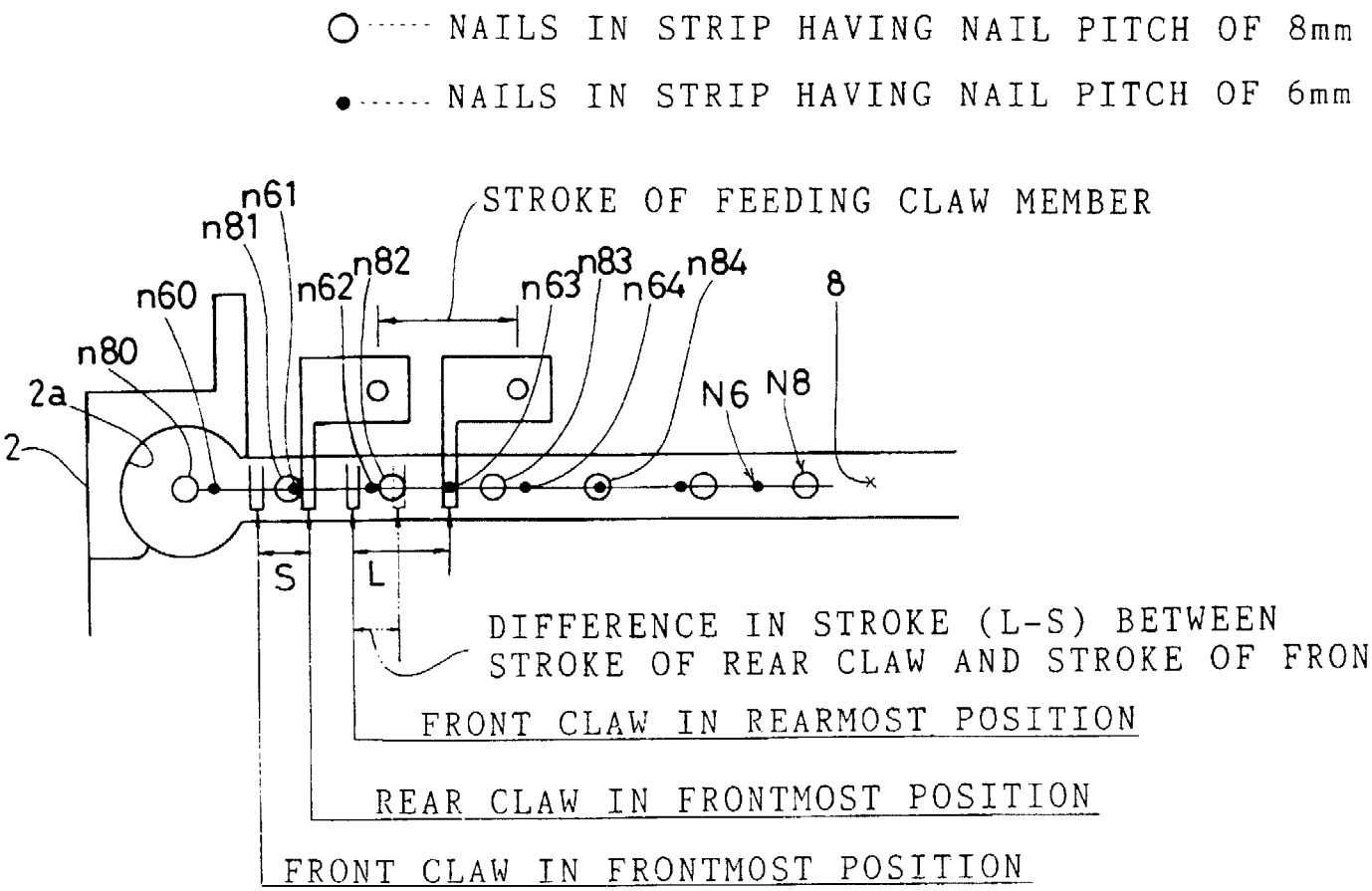
FIG. 8 is a schematic explanatory view showing the operation of the nail feeding device when a strip of nails having a nail pitch of 8 mm is set and when a strip of nails having a nail pitch of 6 mm is set.

FIG. 8 is a schematic view showing the relationship between the feeding claw member 6 and nails $n_{80}$ to $n_{8n}$ of the strip of nails N8 having the nail pitch of 8 mm and the relationship between the feeding claw member 6 and nails $n_{60}$ to $n_{6n}$ of a strip of nails N6 having the nail pitch of 6 mm. Here, in the subscript affixed to n indicating the nail, left side figure represents the pitch of the nails in the strip, and the right side figure represents the order from the frontmost one. For example, $n_{80}$ indicates the frontmost nail in the strip of nails N8 having the nail pitch of 8 mm, and $n_{61}$ indicates the first nail next to the frontmost one in the strip of nails N6 having the nail pitch of 6 mm.

In the initial state where the feeding claw member 6 is positioned in its frontmost position and where the frontmost nail $n_{80}$ or $n_{60}$ is positioned within the nail drive channel 2a, the rear claw 11 is in abutment on the rear side of the first nail $n_{81}$ or $n_{61}$. Also in this state, the front claw 10 and the rear claw 11 are spaced from each other by the smallest distance S.

As the feeding claw member 6 is moved rearwardly after the frontmost nail $n_{80}$ or $n_{60}$ has been driven, the rear claw 11 is moved rearwardly relative to the front claw 10 which is in abutment on the wall part 2c by the biasing force of the spring 12, and the front claw 10 is moved rearwardly after the rear claw 11 has started to move rearwardly, so that the largest distance L is provided between the front claw 10 and the rear claw 11 when the feeding claw member 6 is in the its rearmost position. Such movement of the front claw 10 and the rear claw 11 is not changed irrespective of application of the strips having different nail pitches. When considering the movement of the front claw 10 during the rearward movement of the feeding claw member 6, the front claw 10 is moved forwardly relative to the rear claw 11. Therefore, even if the strip of nails N6 has been set, the front claw 10 is reliably positioned on the front side of the second nail $n_{62}$ as in the case of the strip of nails N8.

In contrast, if the distance between the front claw 10 and the rear claw 11 is not varied during the stroke movement and is fixed to the smallest distance S, the front claw 10 is positioned in a position shown by chain lines in FIG. 8 when the feeding claw member 6 is in the rearmost position. In case of the strip of nails N8, the front claw 10 in this position may enter the front side of the second nail $n_{82}$. However, in case of the strip of nails N6, the front claw 10 may enter the rear side of the second nail $n_{62}$, so that the second nail $n_{62}$ as well as the first nail $n_{61}$ are fed into the driver guide 2a when the feeding claw member 6 is moved forwardly.

Although in FIG. 8, the rear claw 11 in the rearmost position is drawn to overlap with the third nail $n_{63}$, the rear claw 11 actually does not overlap with the third nail $n_{63}$ since the rear claw 11 protrudes into the nail feeding channel 8 after passing the second nail $n_{62}$ during the rearward movement.

As described above, with this embodiment, the stroke of movement of the front claw 10 is shorter than that of the rear claw 11, so that the distance between the front claw 10 and the rear claw 11 increases during the rearward movement of the feeding claw member 6. This means that the front claw 10 can be positioned forwardly from a position which has been resulted in the conventional feeding device. Therefore, the feeding device 1 of this embodiment is operable to reliably feed nails in a strip of nails having a nail pitch which may cause difficulty in feeding the nails one after another when they are applied to the conventional feeding device. Thus, with this embodiment, the range of the nail pitch applicable to the feeding device can be broadened.

Although in this embodiment, the compression spring 12 is incorporated to normally bias the front claw 10 forwardly relative to the rear claw 11, the compression spring 12 may be replaced by a rubber, an air damper or any other biasing element. In addition, although the wall part 2c of the driver guide 2 is incorporated for the front claw 10 to abut thereon, the wall part 2c may be replaced by a stopper pin.

While the invention has been described with reference to a preferred embodiment thereof, it is to be understood that modifications or variations may be easily made without departing from the spirit of this invention which is defined by the appended claims.

What is claimed is:

1. In a fastener driving tool having fastener driving means for driving fasteners one after another, the fasteners being connected in series to each other to form a strip of fasteners, the improvement comprising:

fastener feeding means for feeding the fasteners one after another to a driving position by the fastener driving means;

said fastener feeding means including:

a first claw and a second claw positioned forwardly of said first claw in the feeding direction of the fasteners;

drive means for reciprocally moving each of said first and second claws between a frontmost position and a rearmost position; and stroke adjusting means for providing difference between the stroke of movement of said first claw and the stroke of movement of said second claw, so that the stroke of movement of said second claw is smaller than the stroke of movement of said first claw.

2. The fastener driving tool as defined in claim 1 wherein said first claw is operable to engage one of the nails positioned rearwardly in the feeding direction of the nail to be driven, so that the first claw moves the strip so as to feed the nail to be driven to the fastener driving means, and wherein said second claw is operable to engage the rearmost one of the nails, so that the rearmost one of the nails is moved to be fed to the fastener driving means.

3. The fastener driving tool as defined in claim 1 wherein said stroke adjusting means includes distance holding means and control means, said distance holding means being disposed between said first claw and said second claw for holding a first distance L between said first claw and said second claw, and said control means being operable to act on said distance holding means so that said first distance L is varied to a second distance S which is smaller than said first distance L when said first claw is moved from said rearmost position to said frontmost position, and said control means permitting said second distance S to be varied to said first distance L when said first claw is moved from said frontmost position to said rearmost position.

4. The fastener driving tool as defined in claim 3 wherein said distance holding means includes restraining means and a spring, said restraining means being operable to restrain variations in distance between said first claw and said second claw from said second distance S to said first distance L, and said spring being interposed between said first claw and said second claw so as to normally bias said first claw and said second claw in a direction away from each other.

5. The fastener driving tool as defined in claim 4 wherein said restraining means is a fixed wall formed on the driving tool and confronting said second claw in the feeding direction, so that said second claw abuts on said fixed wall immediately before said first claw reaches its frontmost position and that said spring is compressed to permit variation in distance between said first claw and said second claw from said first distance L to said second distance S when said first claw reaches its frontmost position.

6. The fastener driving tool as defined in claim 5 wherein the fastener driving tool is a nailer, and wherein said fixed wall is formed on a part of a driver guide of the nailer, said driver guide having a nail driving channel formed therein through which a driver is reciprocally moved for driving nails.

7. The fastener driving tool as defined in claim 4 wherein:

said drive means is a piston-cylinder mechanism having a piston reciprocally movable in the feeding direction;

said first claw is mounted on said piston and is fixed in position relative to said piston in the feeding direction;

said second claw is mounted on said piston and is movable relative to said piston in the feeding direction; and said restraining means includes a pin mounted on one of said first claw and said second claw and includes an insertion hole formed in the other of said first claw and said second claw for receiving said pin, said insertion hole being elongated in the feeding direction.

8. The fastener driving tool as defined in claim 7 wherein said first claw and said second claw are pivotally connected to said piston, so that said first claw and said second claw are movable to protrude into a feeding path of the nails and to retract from the feeding path, and wherein a second spring is provided for normally biasing said first claw and said second claw in a direction protruding into the feeding path.

* * * * *